US006026636A

United States Patent [19]

Lorenz et al.

[11] Patent Number: 6,026,636

[45] Date of Patent: Feb. 22, 2000

[54] YARN FALSE TWIST TEXTURING APPARATUS

[75] Inventors: Hellmut Lorenz; Peter Dammann, both of Remscheid, Germany

[73] Assignee: Barmag AG, Remscheid, Germany

[21] Appl. No.: 09/083,721

[22] Filed: May 22, 1998

[30] Foreign Application Priority Data

May 24, 1997 [DE] Germany ..... 197 21 805
Jul. 2, 1997 [DE] Germany ..... 197 28 222

[51] Int. Cl.[7] ..... D01H 7/46

[52] U.S. Cl. ..... 57/290; 57/261; 57/286; 57/292; 57/308; 57/309

[58] Field of Search ..... 57/290, 286, 291, 57/284, 292, 261, 308, 309; 28/247, 249

[56] References Cited

U.S. PATENT DOCUMENTS

| | | | |
|---|---|---|---|
| 2,958,921 | 11/1960 | Gilchrist et al. | 28/62 |
| 3,237,392 | 3/1966 | Crouzet | 57/157 |
| 3,368,335 | 2/1968 | Horvath | 57/34 |
| 4,380,890 | 4/1983 | Stewart, Jr. | 57/286 |
| 5,148,666 | 9/1992 | Bauer et al. | 57/290 |
| 5,359,845 | 11/1994 | Gabalda et al. . | |
| 5,372,004 | 12/1994 | Yamamoto et al. | 57/290 |
| 5,406,782 | 4/1995 | Inuyama et al. . | |
| 5,431,002 | 7/1995 | Treptow | 57/279 |
| 5,671,519 | 9/1997 | Naylor | 28/249 |
| 5,715,670 | 2/1998 | Bartkowiak | 57/284 |

FOREIGN PATENT DOCUMENTS

| | | |
|---|---|---|
| 0 571 975 | 12/1993 | European Pat. Off. . |
| 0 412 429 | 11/1994 | European Pat. Off. . |
| 0 744 481 | 11/1996 | European Pat. Off. . |
| 0 595 086 | 1/1997 | European Pat. Off. . |
| 41 38 509 | 8/1992 | Germany . |
| 42 27 115 | 3/1993 | Germany . |

OTHER PUBLICATIONS

Database WPI, Section Ch, Week 9342, Derwent Publications Ltd., London, GB; Class F02, AN 93–331861, XP002075506 & JP 05 239 725 A (TEIJIN LTD).

*Primary Examiner*—William Stryjewski
*Attorney, Agent, or Firm*—Alston & Bird LLP

[57] ABSTRACT

A yarn false twist texturing apparatus which includes a serially arranged heater, cooling device, and twisting unit. In order to collect and remove the oil vapors arising within the false twist zone, the cooling device is configured as an elongate hollow body, and the yarn is conveyed for cooling in contact with the inside wall of the hollow body. A vapor extraction system is provided which communicates with the interior of the body. In another embodiment, a tubular protective body is arranged between the heater and the cooling device, and the interior chamber of the tubular protective body encloses the yarn and is connected to an extraction device. The advancing yarn may be wetted with a cooling fluid at a location between the heater and the cooling device, to facilitate the volatilization of the oil constituents in the yarn as well as cool the yarn.

26 Claims, 8 Drawing Sheets

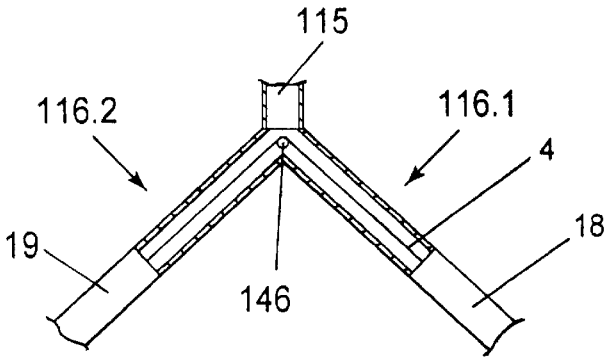
FIG. 11.
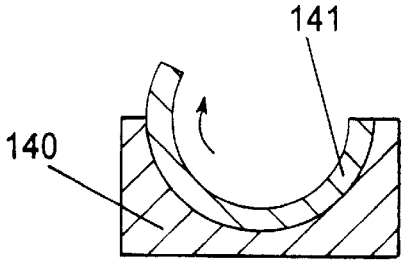
FIG. 12.1
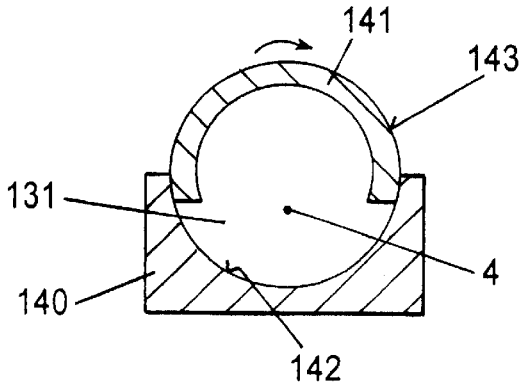
FIG. 12.2

YARN FALSE TWIST TEXTURING APPARATUS

BACKGROUND OF THE INVENTION

The present inventions relate to a yarn false twist texturing apparatus of the type wherein an advancing yarn is guided serially through a heater, a cooling device, and a twisting unit.

The purpose of texturing is to lend a substantially flat yarn a more textile-like appearance and the properties associated therewith. The flat yarn delivered to the texturing machine has a chemical substance, the so-called lubricant, adhering to the yarn in order to enable further processing of the flat yarn by the texturing machine. The lubricant leads to cohesion of the filament bundles, good sliding properties as well as antistatic behavior of the yarn. There are many such substances. What they all have in common is that, at high yarn temperatures, relatively oily vapors are produced and, as a result of the extremely fast helical twisting of the false-twisted yarn, a fine spray mist may be cast off.

From EP 0 571 975 a texturing machine is known, in which the yarn in a twist zone is conveyed through a cooling rail, which has openings in its side walls. Such openings are used to catch the cast-off oil particles and remove them from the region of the yarn. This arrangement however has the major drawback that a considerable portion of drops are cast out of the open cooling rail into the environment. In addition, oily vapors may pass substantially unimpeded out of the open cooling rail. Admittedly, in EP 0 571 975 it is proposed to connect the openings in the groove walls to a suction device but the open arrangement of the extraction openings leads to the problem that only some of the vapors are intercepted and a considerable quantity of ambient air has to be extracted at the same time. An excessively intensive extraction would however lead to an unstable yarn course inside the cooling rail.

Non-extracted vapor condenses as an oily deposit all over the machine and in the factory building, which is not only generally undesirable but also incurs cleaning costs.

Accordingly, an object of the invention is to provide a texturing machine of the type described and wherein processing of the yarn does not lead to substantial pollution by oily deposits. A further object of the invention is to provide an intensive-action cooling device which is tuned to an upstream high-temperature heater.

SUMMARY OF THE INVENTION

The above and other objects and advantages of the present invention are achieved by the provision of a yarn false twist texturing apparatus which comprises means for advancing a yarn through a false twist texturing zone which comprises a heater, a cooling device, and a false twisting unit which are serially arranged with respect to each other, and wherein the cooling device comprises an elongate hollow body or cooling tube positioned such that the advancing yarn contacts an inside wall surface of the tube. The apparatus also preferably includes means for withdrawing vapors which emanate from the yarn as the yarn advances through the false twist texturing zone.

A particularly large amount of dense smoke and vapor is given off by the yarn in the yarn heater, which lies upstream of the cooling device and where the yarn is heated up to around 190 to 250° C. The heater, which may take the form of a contact or hot-air heater, is usually closed by a cover along the yarn course to prevent a free escape of dense smoke into the environment. Disposed in the yarn course downstream of the high-temperature heater is the cooling device. The heater and the cooling device are situated in the false twist zone, i.e. the false twist unit is disposed in the yarn course downstream of the cooling device and results in a false twist, which is built up in the yarn, propagating back as far as the heater. Thus, the problem of vapor and oil spray formation at the yarn arises also upon entry into the cooling device as a result of the heater and an extremely fast helical twisting of the yarn and hence the shedding of oil particles from the yarn.

According to one feature of the invention, the yarn is cooled down in the cooling tube which extends, for yarn guidance, in the yarn running direction. The particular advantage is that the cast-off oil drops and the rising vapor remain in the cooling device. A substantial portion of the vapor settles on the inside walls of the cooling tube where it then condenses. The condensate as well as the cast-off droplets, which collect likewise on the inside wall of the cooling tube, may be collected at the ends of the cooling tube and removed.

A particularly preferred embodiment of the texturing apparatus of the present invention includes provision for withdrawing the vapors which emanate from the yarn as it advances through the false twist texturing zone, and such that only a small portion of ambient air is simultaneously extracted. This is however also advantageous because the small portion of ambient air has the effect of preventing the extraction lines from becoming choked up too quickly.

Since a considerable generation of vapors occurs particularly at the inlet end portion of the cooling device, it is advantageous to connect the extraction device to the cooling tube in the region between the longitudinal center of the cooling tube and the end of the cooling tube at which the yarn enters. In order to dimension the air inlet at the ends of the cooling tube in such a way that no vapor escapes at the free ends, the extraction device is preferably connected to the cooling tube at a distance of about a third of the length from the yarn inlet.

The cooling tube may be closed at one or both ends, with suitable openings for the passage of the yarn. This embodiment of the texturing machine is notable for the fact that it is possible to minimize the portion of ambient air taken in.

The cooling device may comprise a V-shaped cooling rail and a removable cover positioned to overlie the rail. This construction has the advantage that piecing of the yarn is possible in a simple manner. Furthermore, cleaning of the cooling tube may be effected without a greater outlay. With regard to the construction of the cooling tube, it is important for the cover to be sealingly connected to the cooling tube so that no ambient air may penetrate into the cooling tube from the longitudinal side of the cooling device.

In such case, it is also possible to effect a partial overlap of the cooling rail by the cover so that in particular only the inlet region immediately downstream of the heater is covered.

The extraction device may, in the present case, advantageously be connected to the cooling rail or the cover.

The cover, which positively and sealingly covers the cooling rail, is connected to a closing device. In such case, it is particularly advantageous when the closing device is controllable by means of a central control unit. Thus, during piecing or also in the event of failure of the machine, corresponding opening and closing operations may be effected automatically.

A further particularly preferred embodiment provides that the extraction device is connected to the cooling device and the upstream heater. In such case, the heater likewise has a self-contained guide channel so that the vapors generated therein may be removed.

In a further embodiment of the invention, the vapor withdrawing system includes a tubular protective body which is positioned between the heater and the cooling device. The body includes a jacket which encloses the yarn without contact and is open at its ends to form an inlet and outlet for the yarn. The effect achieved thereby is that the vapor rising from the yarn remains in the inner chamber of the protective body. By connecting an extraction device, the vapors are then substantially totally removed. The vapors are thereby prevented from settling in particular on the cooling device where they would, in the form of a condensate, lead to pollution as well as influencing of the yarn cooling.

A condensate outlet may be provided at the lower-lying end of the protective body, so that the condensate in the body can drain to a condensate collecting device. This has the advantage that cast-off oil drops and condensate forming on the inside walls of the body are fully removed. By virtue of the extraction and removal of the condensate, a preliminary cooling of the yarn therefore occurs in the inner chamber of the protective body.

The jacket of the protective body may be provided with openings which allow for the intake of outside air. It is then possible to dispense with an extraction device associated exclusively with the heater. The openings in the jacket of the protective body may be formed, for example, by a plurality of bores distributed in a ring around the periphery or by a gap between the end face of the protective body and the heater.

By virtue of the adjustability of the air gap, the intensity of extraction from the heater may be controlled. The portion of ambient air taken in there may be adjusted according to requirements. A specific portion of ambient air is advantageous in order to prevent rapid choking of the extraction lines. The air gap formed directly at the heater inlet moreover enables sensitive heater extraction, resulting in low heat losses.

The adjustment of the air gap may, in the present case, advantageously be effected by an axial displacement of the protective body in the yarn running direction.

In order to collect the vapors from the yarn arising in the inlet region of the cooling device, it is advantageous when the protective body extends at least over part of the length of the cooling device. This has the particular advantage that the condensate formation occurs on the inside walls of the protective body. As a result, the surface region of the cooling device remains substantially dry. The yarn may therefore be conveyed from the inlet to the outlet along a dry cooling rail. The cooling effect in the yarn is therefore intensified.

In a particularly preferred embodiment of the texturing machine, the cooling device takes the form of a cooling tube, around the periphery of which the yarn is wound. The cooling tube is disposed in the protective body in such a way that no contact between cooling tube and protective body occurs.

The vapors given off by the yarn may pass freely into the inner chamber of the protective body before being extracted or condensing on the inside walls of the protective body. In such case, it is advantageous when there is disposed at the end of the protective body, between the cooling tube and the jacket of the protective body, a bulkhead wall which apart from a yarn outlet opening rests against the periphery of the cooling tube. An escape of vapors is thereby prevented.

The tubular protective body may comprise a bottom part and a top part, which when lying one above the other form an inner closed chamber. The two parts have mating arcuate surfaces when viewed in cross section, so as to be moveable relative to each other such that an opening of the chamber in the longitudinal direction is possible. Thus, the protective body is easily accessible for inserting the yarn and for cleaning the inner region of the protective body. The bottom part and the top part may in such case be connected to one another by a hinged mechanism. It is however also possible for the cover to take the form of half shells, which may be displaced concentrically one into the other so that, upon a rotation executed in a peripheral direction, the protective body is opened or closed.

The protective body has at least one opening, by which the inner chamber of the protective body is connected to an extraction device. Disposed inside the protective body may be a nozzle for wetting the yarn with a cooling fluid. The nozzle is connected to a metering device, which is disposed outside of the protective body, and which meters the cooling fluid in terms of its quantity and delivers it to the nozzle. This construction of the texturing machine and the method according to the invention have the advantage that wetting of the yarn leads to an additional evaporation which binds the lubricant vapors and/or leads to a specific washing of lubricant residues from the yarn. It is thereby assured that the yarn running onto a cooling rail disposed in the yarn running direction downstream of the heating device is not contaminated by adherence of the lubricant residues and the cooling rail may be kept absolutely dry, which particularly in the case of contact cooling leads to an improved cooling action.

Wetting of the yarn moreover has the advantage that the yarn is already cooled immediately after leaving the heater. It is therefore possible, particularly given high yarn speeds of>1000 m/min, to realize a short cooling section inside the texturing machine. A further advantage of said invention is the possibility of metering the cooling fluid. It is therefore possible to achieve a defined cooling action. Residues of the cooling fluid are moreover prevented from passing onto the cooling surface of the cooling device.

By using nozzles which atomize the cooling liquid, an extensive, uniform wetting of the yarn inside the protective body may be achieved.

To prevent the yarn from being able to entrain adhering cooling fluid and the downstream cooling device from being polluted, the quantity of cooling fluid is determined by the metering device in such a way that the output quantity of cooling fluid is smaller than the quantity of cooling fluid evaporated from the yarn. The metering device may take the form of, for example, a metering valve or a metering pump. In the case of a metering pump, said pump is preferably self-priming so that in the event of clogging of the nozzle channel self-cleaning of the nozzle is effected as a result of pressure build-up.

BRIEF DESCRIPTION OF THE DRAWINGS

Some of the objects and advantages of the present invention having been stated, others will appear as the description proceeds, when considered in conjunction with the accompanying drawings, in which:

FIGS. 10 and 11 are further embodiments of a protective body disposed between the heater and the cooling device;

FIGS. 12.1 and 12.2 are cross-sections through a further embodiment of a cooling device.

DETAILED DESCRIPTION OF THE PREFERRED EMBODIMENTS

Figure 1:
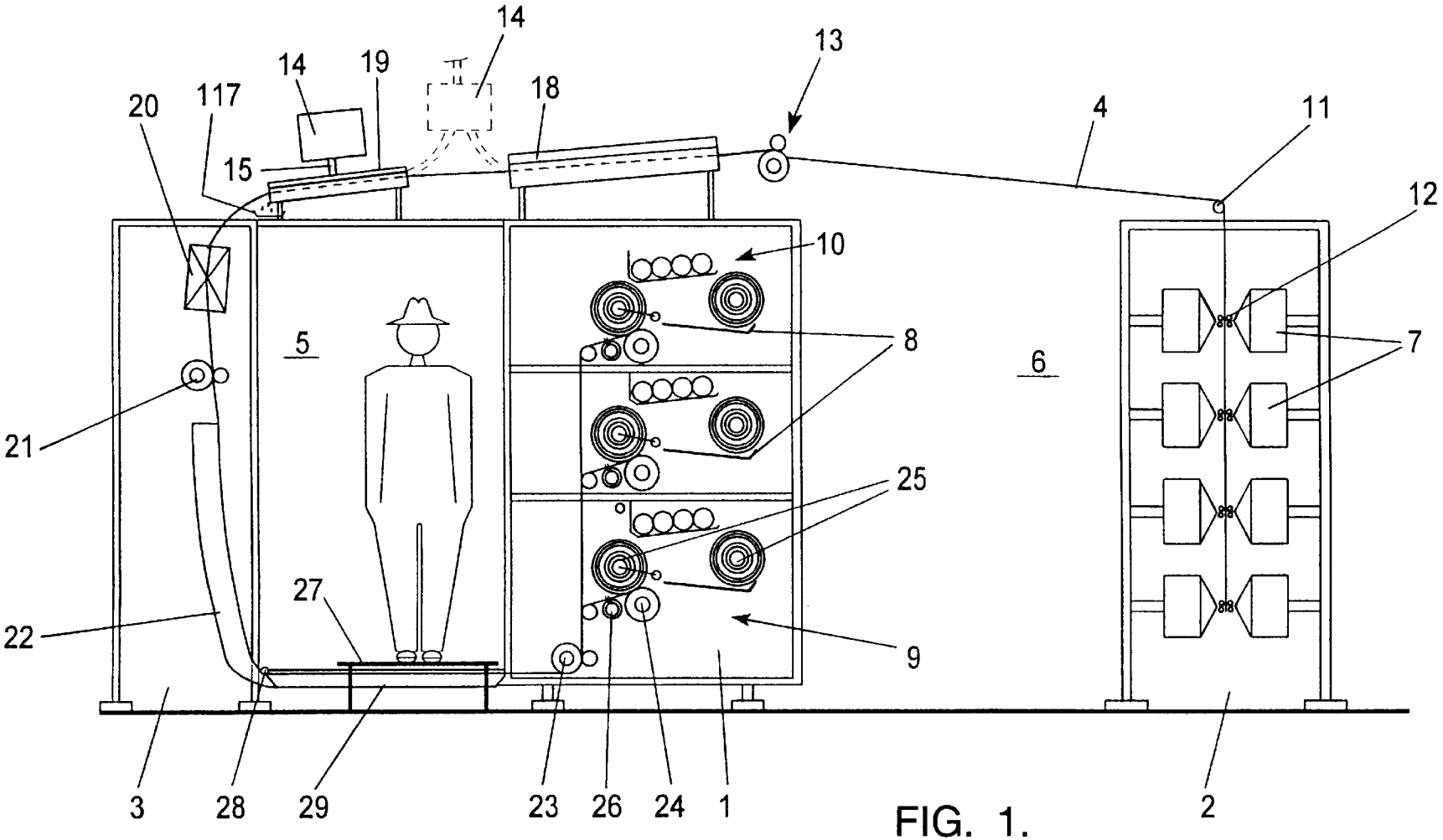
FIG. 1 is a diagrammatic view of a yarn texturing apparatus which embodies the present invention.

FIG. 1 is a diagrammatic view of a yarn texturing apparatus according to the invention. The texturing apparatus comprises a creel frame 2, a processing frame 3 and a winding frame 1. An attending aisle 5 is formed between the processing frame 3 and the winding frame 1. At the opposite side of the winding frame 1 to the attending aisle 5, the creel frame 2 is disposed at a distance from the winding frame 1. A doffing aisle 6 is therefore formed between the winding frame 1 and the creel frame 2.

The texturing apparatus comprises in longitudinal direction—in FIG. 1, the drawing plane equals the transverse plane—a plurality of processing points, with one yarn being processed at each processing point. The take-up devices take up a width of three processing points. There are therefore in each case three take-up devices 9—of which more details are given later—arranged one on top of the other in a column on the winding frame 1. Each processing point comprises a supply bobbin 7, on which a thermoplastic yarn 4 is wound. The yarn 4 is withdrawn via an end yarn guide 12 and a guide roller 11 under a specific tension by the first delivery mechanism 13. In the embodiment according to FIG. 1, the yarn is conveyed between the creel frame 2 and the delivery mechanism 13 without tubular guidance. However, such tubular guides may be used if desired.

Situated in the yarn running direction downstream of the first delivery mechanism 13 is a first, elongate heater 18, through which the yarn 4 runs, so that the yarn is heated to a specific temperature. The heater takes the form of a high-temperature heater, in which the heating surface temperature is above 300° C. Such a heater is known, for example, from EP 0 412 429 and corresponding U.S. Pat. No. 5,148,666, the disclosures of which are incorporated herein by reference.

Situated downstream of the heater 18 is a cooling device 19. In the present case, the heater 18 and the cooling device 19 are arranged in a flush manner, one downstream of the other, so as to form a substantially straight yarn course.

The cooling device 19 defines a cooling tube, in which the yarn 4 is conveyed. Such cooling tube, a detailed description of which is provided later, is connected by a suction line 15 to an extraction device 14. At its lowest point in the machine, the cooling device has a condensate collecting device 117, the function of which is described in detail later.

Situated downstream of the cooling device 19 is a diagrammatically illustrated false twister 20. The false twister 20 may take the form of, for example, a conventional friction unit having rotating friction discs disposed on three shafts. In the false twister, the yarn is conveyed through the nip formed by the friction discs and twisted.

Downstream of the false twister 20 is a second, further delivery mechanism 21 used to draw the yarn 4 through both the heater 18 and also the cooling device 19. A second heater 22 (set heater) might be disposed in yarn running direction downstream of the second delivery mechanism 21. The set heater may take the form of a curved heating tube surrounded by a heating jacket, the heating tube being heated up to a specific temperature from the outside using steam. The set heater 22 might also, like the first heater, take the form of a high-temperature heater.

Seamlessly adjoining the second heater 22 in the yarn running direction is a levelling tube 29 of the type known from EP 0 595 086 and U.S. Pat. No. 5,431,002. The effect thereby achieved is that the yarn 4 conveys the atmosphere of the heater 22 into the levelling tube 29. Situated in the bend between the heater 22 and the levelling tube 29 is a yarn guide 28.

A further, third delivery mechanism 23 is situated at the output end of the levelling tube 29. Situated upstream or downstream thereof is a lubricating device (not shown here), which lubricates the yarn 4 before the yarn runs into a take-up device 9. In the take-up device 9, the yarn is wound onto a take-up bobbin 25, which is driven at the periphery by a friction roller 24. Situated upstream of the friction roller 24 is a traversing device 26, by means of which the yarn 4 is conveyed to and fro along the take-up bobbin 25 and wound onto the latter to form a cross wound package.

In the texturing machines according to the invention it is possible to dispose below the second heater, instead of the levelling tube 29, first in place of the yarn guide 28 the third delivery mechanism 23 and then provide a tangle nozzle followed by a further delivery mechanism. By such means, it becomes possible to swirl the treated yarn with an adjustable yarn tension in the tangle nozzle by blowing air onto it and to intermingle the filaments.

Situated above the levelling tube 29 is a platform 27 used as an attending aisle 5. The attending aisle 5 is formed between the processing frame 3 and the winding frame 1. Disposed above the attending aisle 5 is the cooling device 19, which is supported substantially on the processing frame 3. Disposed in the processing frame are, in accordance with the yarn course, the false twister 20, the second delivery mechanism 21 and the second heater 22.

At the winding frame 1, in the top region at the side remote from the attending aisle, the first delivery mechanism 13 is disposed immediately upstream of the inlet of the first heater 18. The heater 18 is likewise supported on the winding frame. In accordance with the yarn course, at the bottom end of the winding frame the third delivery mechanism 23 is fastened in the winding frame 1. The take-up devices 9 are moreover disposed in the winding frame 1.

The take-up device 9 comprises a bobbin store 8, which is used to receive the full bobbin once a full take-up bobbin 25 has been produced at the take-up device. For removal of the full bobbin 25, the spindle support is swivelled and the full bobbin deposited on a roll-off track. The roll-off track is part of the bobbin store 8. The full bobbin 25 waits on the roll-off track until it is transported away. For this reason, the roll-off track of the bobbin store 8 is disposed at the side of the winding frame 1 adjacent to the doffing aisle 6 and remote from the attending aisle 5. There is further associated with each take-up device 9 a tube supply device 10, which is not described in any greater detail.

The yarn 4 in the present case is withdrawn from a supply bobbin 7 and conveyed into a false twist zone by means of the first delivery mechanism 13. The false twist zone in the present case comprises the heater 18, the cooling device 19 and the false twist unit. Inside the false twist zone a drawing and fixing of the yarn 4 is effected. The yarn 4 is withdrawn from the false twist zone by the second delivery mechanism 21 and then conveyed with the aid of a third delivery mechanism 23 under shrinkage conditions through a second heater 22. Downstream of the third delivery mechanism 23 the yarn 4 is conveyed to the take-up device 9 and wound into a bobbin 25. During such sequence, particularly while the yarn 4 is being heated in the heater 18, the lubricant adhering to the yarn 4 is released as a result of evaporation. Furthermore, because of the twist running back in the yarn, the yarn will execute a rapid helical twisting motion which additionally causes a shedding of lubricant. In order to collect the vapors and oil spray being released, according to the invention the cooling device 19 is designed with a cooling tube and the cooling tube is connected to an extraction device. The cooling device 19 and the extraction device 14 are connected to one another by a line 15.

In FIG. 1, dashes illustrate a further embodiment of an extraction device, which is connected both to the cooling device 19 and to the heating device 18. Such arrangement enables the vapors, which are produced to a considerable extent in the heating device, to be extracted from the heating device simultaneously with the vapors from the cooling device.

Figure 2:
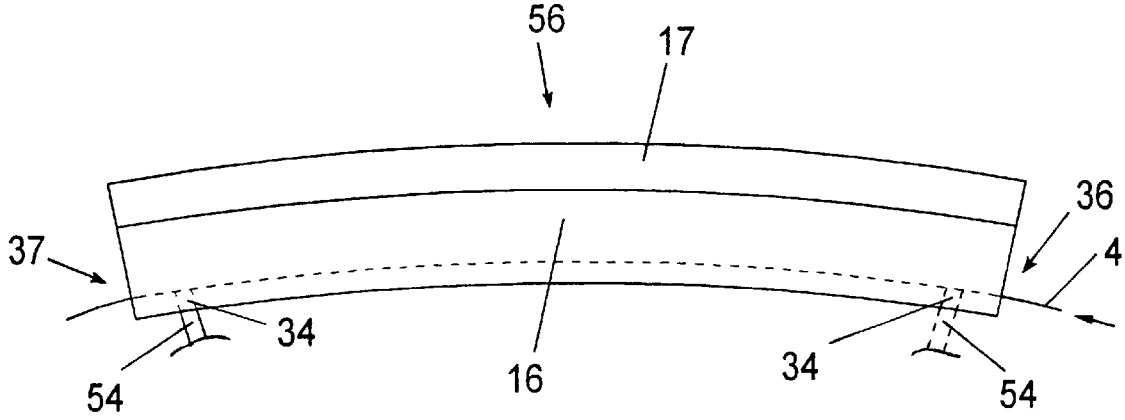
FIG. 2 is a side elevation view of a cooling device which embodies the present invention.
Figure 3:
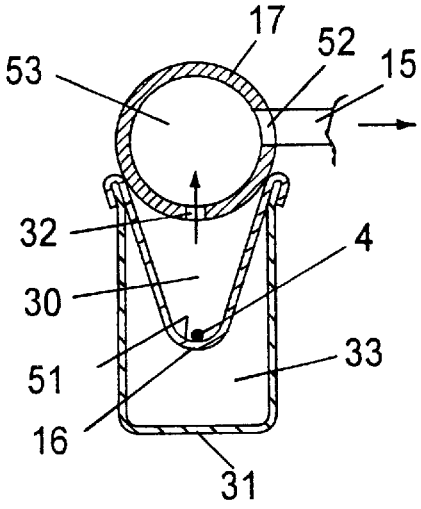
FIG. 3 is a cross section of the cooling device of FIG. 2.

FIGS. 2 and 3 show a further embodiment of a cooling device according to the invention. Here, the hollow body 56 of the cooling device is formed by a cooling rail 16 and a cover 17. The cooling rail 16 has a V-shaped profile cross section and is curved in the yarn running direction. As a result, a yarn 4 conveyed through the cooling rail 16 will be applied against the groove bottom 51 of the cooling rail 16. The yarn 4 enters the cooling device at an inlet 36 and leaves the cooling device at the outlet 37. The cooling tube 30 is formed in that the cover 17 closes off the open, V-shaped cooling rail profile of the cooling rail 16 in longitudinal direction. The cover 17 in the present case takes the form of a tube which is closed both at the end directed towards the inlet and at the end directed towards the outlet. The tube may be curved, its shape corresponding substantially to the shape of the cooling rail. It is however also possible to make a straight tube from a pliant, flexible material, e.g. a plastic material, which tube as a result of loading adopts the shape predetermined by the cooling rail. In such case, the outside diameter of the tubular cover 17 is positively applied in dependence upon the respective radius of curvature against the inner profile walls of the cooling rail 16. The covering extends over the entire length of the cooling rail 16. The formed cooling tube 30 is open both at the inlet 36 and at the outlet 37. The cover 17 at its side directed towards the cooling rail 16 has at least one or more bores 32 distributed over the length of the cooling section. Via the bores 32 a connection exists between the cooling tube 30 and the cover chamber 53 formed in the cover. The cover 17 has at any desired point outside of the cooling tube 30 an opening 52, to which a suction line 15 is connected. The suction line 15 connects the cover 17 to an extraction device (not shown here).

The cooling rail 16 has a discharge opening 34 in the region of the inlet 36 and/or in the region of the outlet 37. The placement of the discharge opening 34 is dependent upon the position of the hollow body 56 inside the machine. As a rule, the discharge opening 34 is positioned at the lowest-lying point. Each discharge opening 34 is connected by a line 54 to a collecting container for condensate. The condensate collecting device described here is suitable for collecting and removing the condensate arising inside the hollow body. Given a normal environment, however, condensate also arises on the outside of the walls of the hollow body 56. Such condensate may likewise be removed by means of a collecting device mostly in the form of a container. The container might be connected, for example, to a suction device so that the condensate may be collected from each processing point inside the texturing machine and centrally removed.

The cooling rail 16 is disposed inside the cooling device in a carrier 31 with a U-shaped profile. In the present case, the cooling rail 16 and the carrier 31 are connected to one another at the ends of their limbs so as to form a chamber 33, which is closed at the ends. The chamber 33 is filled with a cooling medium. The cooling medium may in the present case also be enclosed in a cooling circuit so that the medium inside the chamber 33 is regularly changed. The cooling medium in the chamber 33 keeps the cooling rail 16 at a temperature required for yarn cooling.

Given the above arrangement of the cooling device, the vapors and oil spray emanating from the yarn are enclosed in the cooling tube 30 and then extracted via the bores 32 of the cover chamber 53 and the opening 52. In the present case, ambient air may penetrate into the cooling tube 30 only through the openings at the inlet 36 and at the outlet 37. Thus, a relatively small amount of ambient air is taken in. Given such construction, the suction line 15 is disposed preferably in the middle region of the elongate cooling tube 30. The condensate collecting in the groove bottom 51 of the cooling rail 16 may, in said cooling device, be removed through the openings 34 and the lines 54, respectively.

Figure 4:
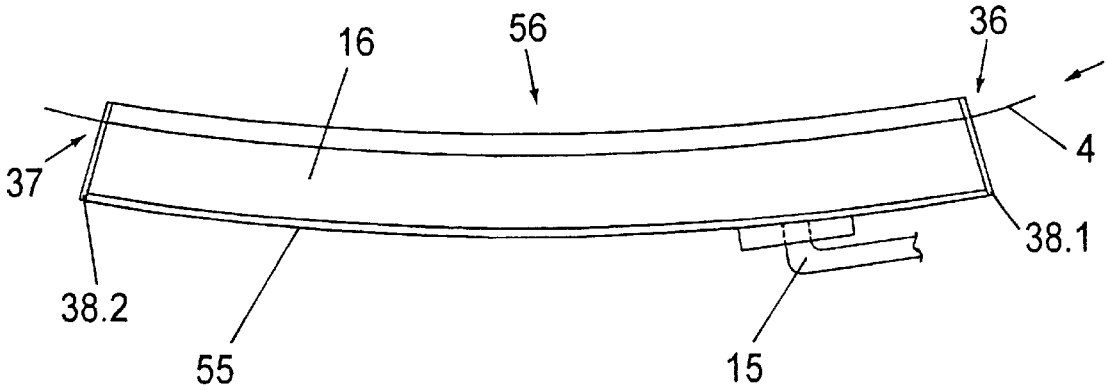
FIG. 4 is a view similar to FIG. 2 and illustrating a further embodiment of the cooling device of the invention.
Figure 5:
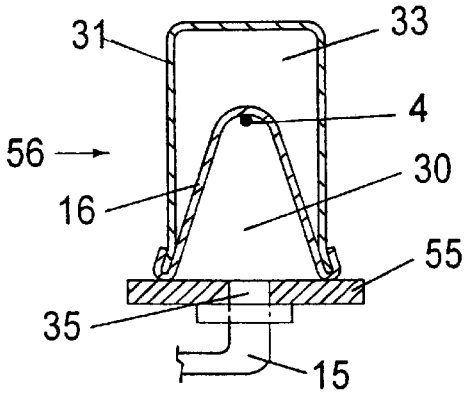
FIG. 5 is a cross section of the cooling device of FIG. 4.

FIGS. 4 and 5 show a further embodiment of a cooling device of the type which might be usable, for example, in the texturing machine according to FIG. 1. Here, the hollow body 56 is formed by a cooling rail 16 and a cover 55. The cooling rail 16 and the carrier 31 accommodating the cooling rail 16 are designed as in the construction of the cooling device of FIGS. 2 and 3 and reference is made to the description pertaining to FIGS. 2 and 3. Compared to FIG. 2, however, the cooling device of FIGS. 4 and 5 is oriented in such a way that the V-shaped profile of the cooling rail 16 has its elongate opening directed towards the bottom of the machine. This construction has the advantage that the yarn may easily be inserted from below into the cooling device. In this construction of the cooling device, the cooling tube 30 is formed by the V-shaped cooling rail 16 and a plate-like cover 55 resting on the free ends of the limbs. The cover 55 is in the present case applied in a friction-locking manner onto the cooling rail 16. The cooling rail 16 and the cover 55 have a curvature uniformly directed in the yarn running direction so that the cooling rail is covered over the entire cooling section. The cover 55 has an opening 35, to which the suction line 15 is connected. Via the opening 35 the cooling tube 30 is connected to the suction line 15 and to an extraction device connected to the suction line. The cooling tube 30 is substantially closed at the inlet end 36 by an end screen 38.1 and at the outlet end 37 by an end screen 38.2. The end screens 38.1 and 38.2 have only the one opening required for the yarn course. As a result, the suction action of the extraction device is boosted to such an extent that, in the borderline case, a slight partial vacuum may be produced in the channel.

The possibility however also exists of effecting the end covering only at one end of the cooling tube 30. At the open end, depending on the intensity of extraction, ambient air is additionally taken in. The best location for the—unilateral—end screen and the junction of the extraction device depends upon the spatial position of the cooling device and upon the yarn running direction because, on the one hand, the yarn entrains the vapor but, on the other hand, because of the stack effect the hot vapor tends to rise.

In the previously described embodiments of the cooling device, the extraction device is coupled by a suction line to the cover 17 or 55 of the cooling device. It is however also possible for the connection between the cooling tube 30 and the extraction device to be formed by an opening in the cooling rail 16. For the connection to the cover 17 or 55, the suction line 15 is preferably made flexible, e.g. in the form of a hose. Thus, an opening and closing motion of the cooling tube 30 required for yarn piecing may be effected by means of the suction line. The opening and closing of the cooling tube 30 is effected in the present case by means of a closing device connected to the cover of the cooling device. Said closing device might, for example, take the form of a sliding guide, which displaces the cover substantially at right angles to the yarn course and hence effects opening of the cooling tube 30. Further embodiments of a closing device are illustrated in FIGS. 6 to 8.

Figure 6:
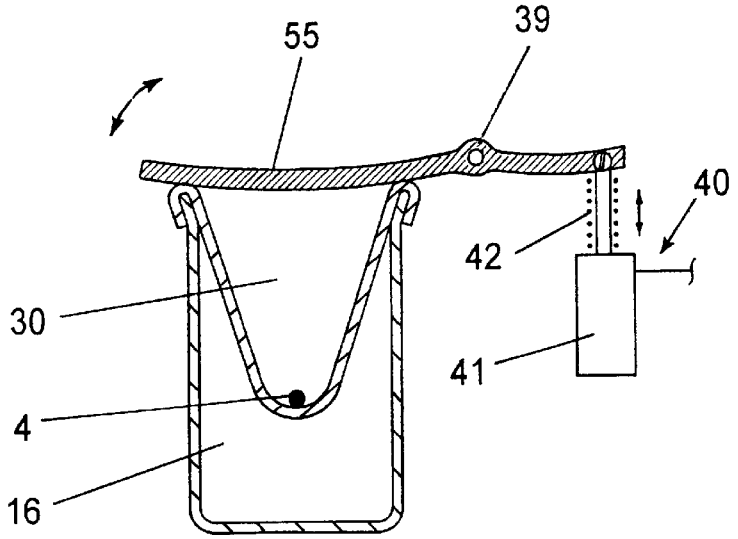
FIGS. 6 to 8 are further embodiments of the cooling device with a closing device for the cover.

In FIG. 6, the cooling tube 30 is formed by the cooling rail 16 and a plate-like cover 55. The plate-like cover 55 is shaped in such a way that a specific form closure between the cover and the profile of the cooling rail 16 is possible. The cover 55 is made longer towards one side of the cooling rail 16 and mounted on a pivot axis 39 formed substantially parallel to the cooling rail 16. At the free end of the cover 55 at the opposite side of the pivot axis 39 to the cooling rail 16, a closing device 40 acts upon the cover 55. The closing device 40 comprises an actuator 41 which, when operated against a spring 42, pivots the cover 55 about the pivot axis 39 in such a way that the cooling tube 30 is opened. Control of the closing device 40 is effected in the present case by a central control unit (not shown here). Thus, for piecing of the yarn or when the machine is stationary, the cover 55 is opened or closed by means of the closing device 40. Closing of the cover 55 is effected automatically by means of the spring 42 as soon as load is removed from the actuator 41.

Figure 7:
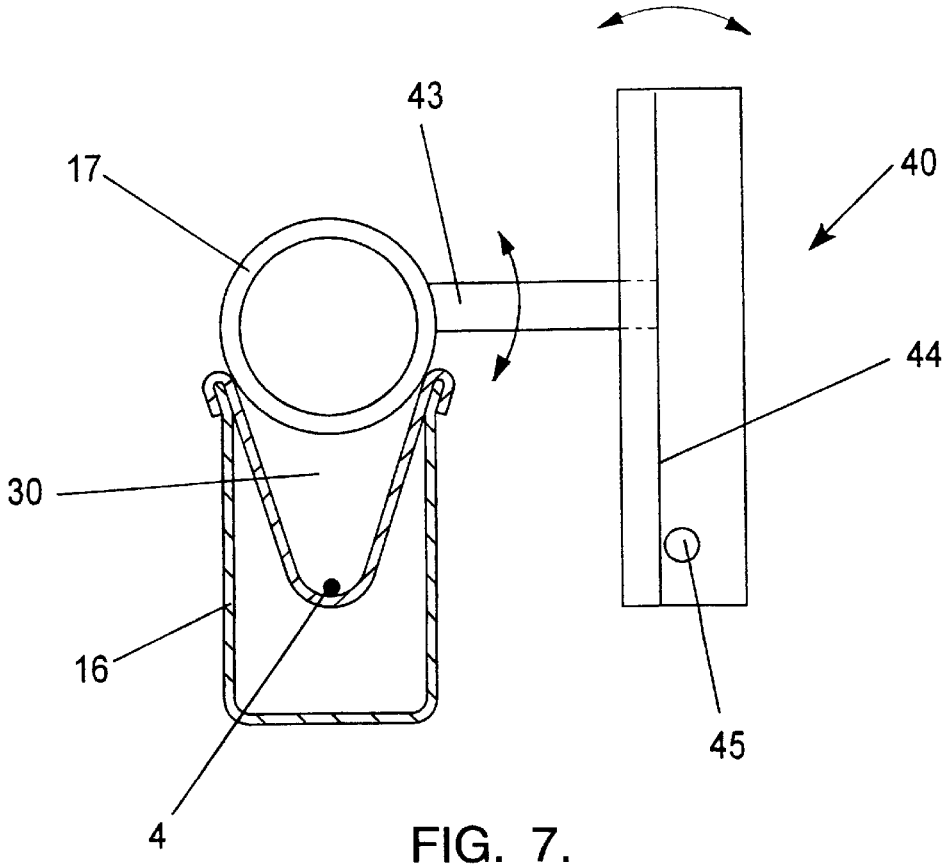

In FIG. 7, the cooling tube 30 is formed by the cooling rail 16 and a tubular cover 17. The tubular cover 17 is fastened to a carrier 43, which is connected to a closing device 40. In this case, the carrier 43 may be pivoted on a guide 44 of the closing device in a vertical direction or about a pivot axis 45 of the closing device at right angles to the cooling device. The vertical motion of the carrier 43 and hence of the cover 17 may be effected, for example, by means of a piston/cylinder unit. The pivoting motion may be executed, for example, by means of a separate actuator or by a combination between the piston/cylinder unit executing the vertical motion and a link guide. The last-mentioned construction has the advantage that both the vertical motion and the pivoting motion are controlled by a single actuator only. Here too, the closing device is controlled by a central control device. Given the arrangement shown in FIG. 7, the carrier 43 might also be replaced by a grab, which would be controlled by means of the closing device.

Figure 8:
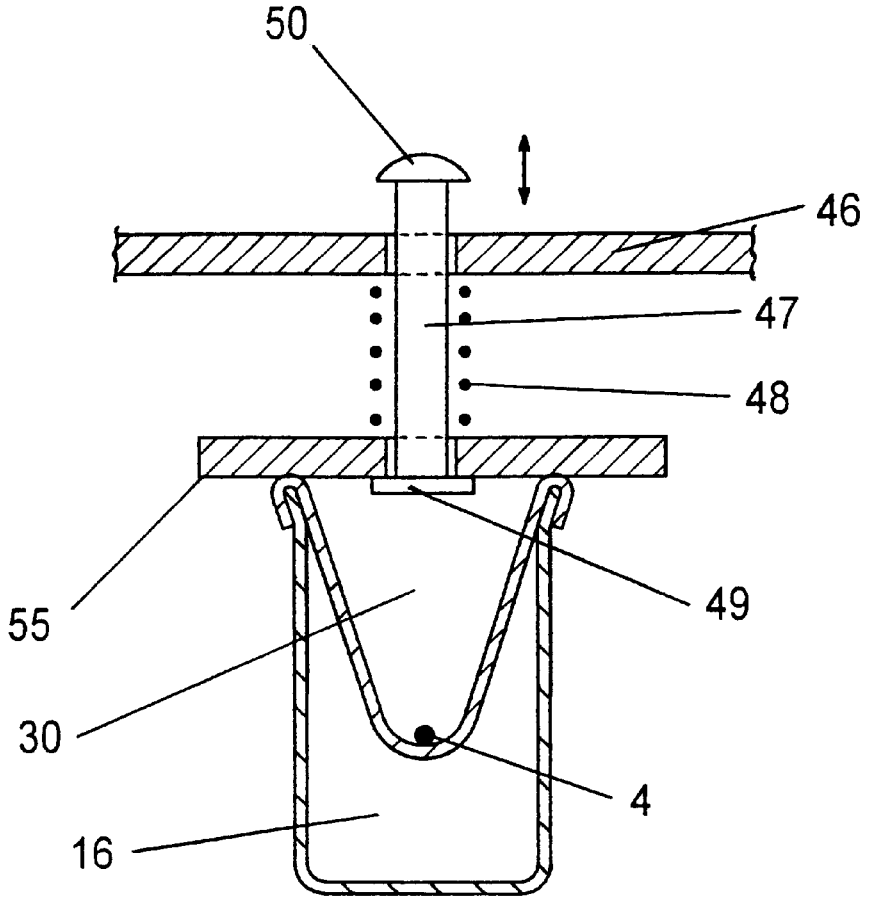

FIG. 8 shows a further embodiment of a closing device. Here, the cooling tube 30 is formed by the plate-like cover 55 and the cooling rail 16. A pin 47 is fastened by the fastening means 49 to the plate-like cover 55. The pin 47 is movably supported in a holder 46. The holder 46, like the cooling device, is disposed in a fixed manner in the machine. Disposed between the cover 55 and the holder 46 is a spring 48 which encloses the pin. The spring 48 is preloaded towards the holder 46 in such a way that the cover 55 is held in a friction-locked manner on the cooling rail 16. The pin 47 at its free end has a handle 50. By manually operating the pin 47 in a vertical direction towards the spring 48, the cover 55 may therefore be lifted off the cooling rail 16. The cooling tube 30 is therefore opened so that the yarn 4 may be inserted into the cooling rail 16.

The cooling device according to the invention may equally be formed by a single-piece hollow body. In such case, the yarn is threaded into the cooling tube. An opening and closing of the cooling tube in longitudinal direction is not possible.

Figure 9:
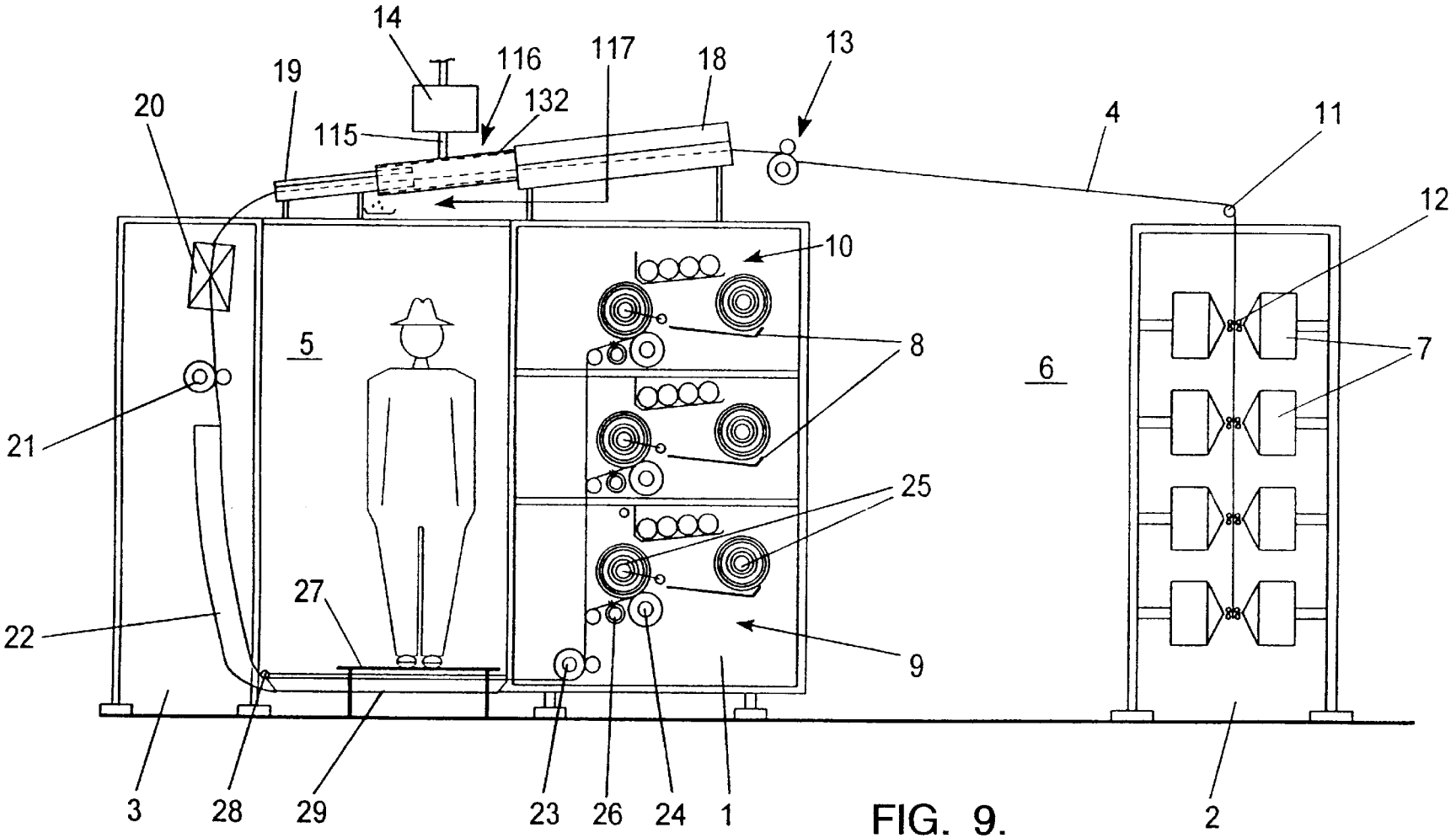
FIG. 9 is a diagrammatic view of a texturing apparatus according to the invention and which includes a protective body between the heater and the cooling device.

FIG. 9 shows an embodiment of a texturing machine having a protective body in the false twist zone. As the texturing machine shown in FIG. 9 is of substantially the same design as the texturing machine according to FIG. 1, reference is made to the description pertaining to FIG. 1. The structural parts with an identical function have been given identical reference characters in FIG. 9.

A protective body 116 is disposed between the heater 18 and the cooling device 19. The protective body 116 comprises a jacket 132 which encloses the yarn without contact. At the ends, the protective body 116 is open so that the yarn 4 runs without contact through the protective body 116. The protective body 116 extends from the heater outlet to the cooling device 19, a first sub-section of the cooling device being likewise enclosed by the jacket 132 of the protective body 116.

The protective body 116 is connected by an opening in the jacket 132 to a suction line 115, which at its other end is coupled to an extraction device 14.

In the region of the end of the protective body 116 situated lower down in the machine—in the present case, the end directed towards the cooling device 19—a condensate outlet is introduced in the jacket 132 and connects the inner chamber of the protective body 116 to a condensate collecting device 117.

In the texturing machine according to FIG. 9, the yarn 4 is withdrawn from the supply bobbin 7 and conveyed into a false twist zone by means of the first delivery mechanism 13. The heater 18, the protective body 116, the cooling device 19 and the false twist unit are disposed in the false twist zone so that a drawing and fixing of the yarn 4 is effected inside the false twist zone.

The yarn 4 is withdrawn from the false twist zone by the second delivery mechanism 21 and then fed by a third delivery mechanism 23 under shrinkage conditions through a second heater 22. In the present case, a further delivery mechanism might be inserted between the heater inlet 22 and the second delivery mechanism 21. By means of the additional delivery mechanism it is possible, independently of the drawing in false twist zone, to effect separate adjustment of the yarn tensions for the shrinkage treatment between the third delivery mechanism and the additional delivery mechanism. Downstream of the third delivery mechanism 23, the yarn 4 is conveyed to the take-up device 9 and wound into a bobbin 25.

During the above sequence, particularly while the yarn 4 is being heated in the heater 18, the lubricant adhering to the yarn 4 is released as a result of evaporation. Furthermore, because of the twist running back in the yarn, the yarn will execute a rapid helical twisting motion which additionally causes a shedding of lubricant. For collecting the released vapors and oil spray, according to the invention the protective body 116 is disposed adjacent to the outlet of the heater 18. The inner chamber of the protective body 116 is connected to an extraction device 14. Thus, the vapors emanating from the yarn 4 are removed before entry into the cooling device 19. The protective body 116 which, for example, may advantageously be formed by a tube is additionally connected to a condensate collecting device. By such means, the condensate on the inside walls of the protective body is removed and collected.

The arrangement of the protective body immediately in front of the heater outlet moreover offers the possibility of using the extraction device 14 to extract vapors from the heating channel of the heater 18. To said end, the end of the protective body is disposed immediately adjacent to the outlet of the heater 18.

The cooling device 19 takes the form of a cooling rail having a groove bottom, along which the yarn 4 is conveyed with contact. In this case, vapors typically emanate from the yarn as the yarn enters the cooling device. In order likewise to remove such vapors, the protective body extends over at least a partial length of the cooling rail. The protective body might be lengthened in such a way that the entire cooling device is situated inside the protective body 116. Given use of a cooling device having a cooling tube 30 penetrated by the yarn, the protective body 116 may be disposed only as far as immediately in front of the inlet of the cooling device 19.

The effect achieved by removal of the vapor of the condensate prior to entry of the yarn into the cooling device is that the yarn is subjected to more intensive cooling in the cooling device 19. A formation of condensate inside the cooling device 19 is avoided. Thus, the pollution of the cooling device is substantially reduced. Furthermore, the yarn is conveyed in a substantially dry yarn running track inside the cooling device 19.

To increase the formation of condensate inside the protective body 116, the jacket of the protective body 116 might be cooled, e.g. by a cold air stream.

Figure 10:
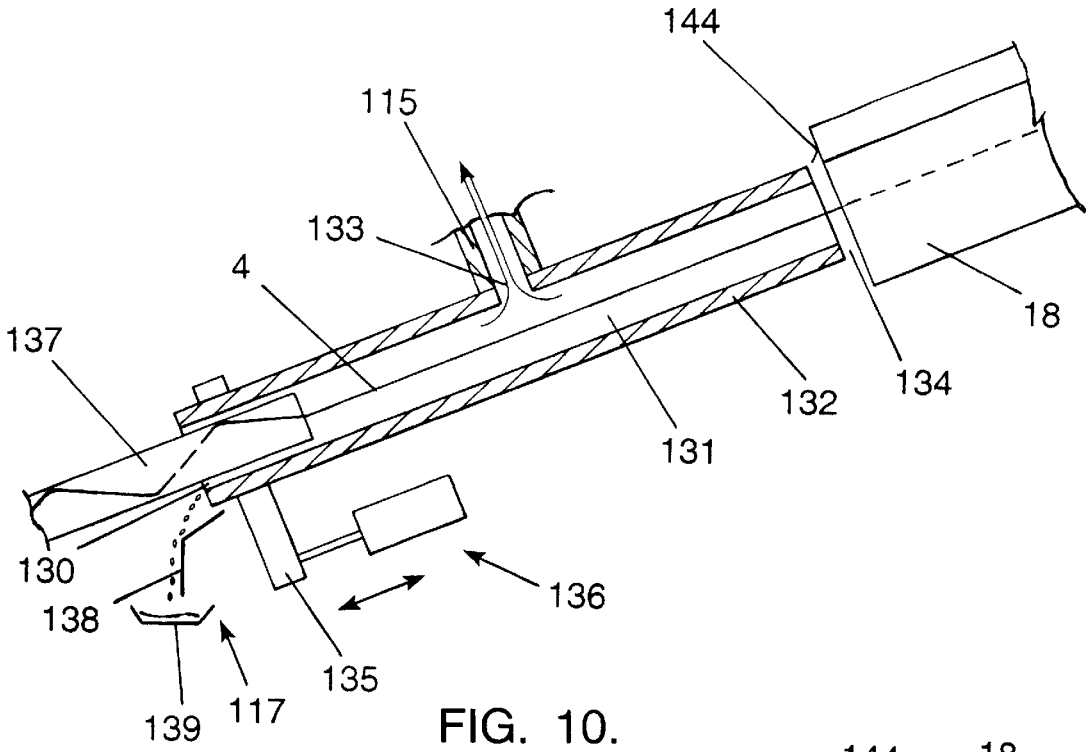

FIG. 10 shows a further embodiment of a protective body of the type which might be used in a texturing machine according to FIG. 9. Here, the cooling device is formed by a cooling tube 137. For cooling, the yarn is conveyed helically along the outside surface of the cooling tube 137. The cooling tube is cooled internally, e.g. by a flowing cooling medium.

The protective body 116 once again comprises a jacket 132, which forms an inner chamber 131 penetrated by the yarn 4. The ends of the protective body 116 are open. The jacket 132 has an opening 133 at a medial location along its length, and the suction line 115 is fastened, concentrically with the opening 133, to the jacket 132. The suction line 115 leads to an extraction device (not shown here) so that the inner chamber 131 is connected by the opening 133 and the suction line 115 to the extraction device.

The cooling tube 137 projects into the inner chamber 131 of the protective body 116 through the open end directed towards the cooling device and the yarn is wound around the periphery of the cooling tube 137. Formed between the cooling tube and the jacket 132 is an opening 130, which is used to drain the condensate. To this end, a drainage plate 138 is disposed below the protective body 116 at the end of the jacket 132. The drainage plate 138 leads to a container 139 which receives the dripping condensate. The jacket 132 of the protective body 116 is fastened to a holder 135. The holder 135 is coupled to an adjusting device 136 which is mounted on the machine frame. The adjusting device 136 enables a movement of the holder 135 in an axial direction of the protective body 116. By means of the adjusting device 136, the size of the gap 134 formed between the heater outlet 144 and the open end of the protective body 116 may be varied. By adjusting the gap 134, the ambient air flowing into the inner chamber 131 may be adjusted. It is also possible thereby to control the extraction of the heating device 18. When the gap 134 is closed by adjusting the protective body 116, i.e. the open end of the protective body 116 abuts the end face of the heater, and intensive extraction of the heating device 18 is effected. With an increasing gap width, the extraction of the heating device diminishes.

FIG. 11 shows a further embodiment of a protective body for a kinked yarn course between the heating device and the cooling device. The yarn 4 is conveyed between the heater 18 and the cooling device 19 via a yarn guide 146. Disposed between the heater 18 and the cooling device 19 is a protective body comprising two sub-sections. The first sub-section 116.1 of the protective body encloses the yarn 4 in the sub-section between the heater 18 and the yarn guide 146. The second sub-section 116.2 of the protective body encloses the yarn 4 in the region between yarn guide 146 and the cooling device 19. In the region of the interface of the two sub-sections 116.1 and 116.2, a suction line 115 is connected to the sub-sections so that the inner chambers of the protective body are connected to an extraction device.

For piecing the yarn and for cleaning the protective body, it is advantageous when the protective body comprises a bottom part and a top part, which are movable relative to one another. FIGS. 12.1 and 12.2 show such an arrangement. In this arrangement, the internal contour 142 of the bottom part 140 is fashioned congruently with the external contour 143 of the top part 141. The top part 141 is coupled to the bottom part 140 so as to be rotatable in a peripheral direction.

In FIG. 12.1, the protective body 116 thus formed is shown in the open state, wherein the top part 141 is swivelled into the inner region of the bottom part 140. A yarn 4 may therefore be inserted into the open groove thus formed. Then, for closing the protective body, the top part 141 is rotated out of the inner region of the bottom part 140. In FIG. 12.2, the protective body is shown in the closed state, wherein the top part 141 and the bottom part 140 form a closed inner chamber 131 which encloses the yarn 4.

It is however also possible for the protective body 116 to comprise a single part having a longitudinal slot formed in yarn running direction for yarn piecing purposes.

Figure 13:
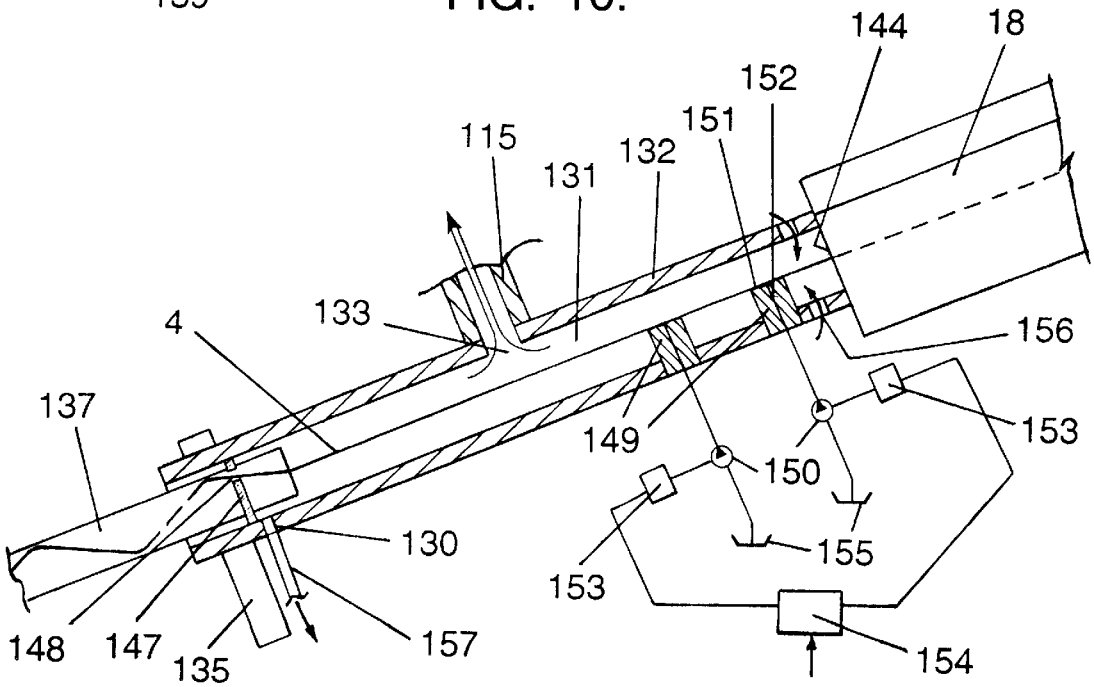
FIG. 13 is an embodiment of a protective body with a nozzle device.

FIG. 13 shows an embodiment of a protective body having a nozzle device and which may be used, for example, in a texturing machine according to FIG. 1 or according to FIG. 9. In a texturing machine constructed in such manner, the yarn immediately after heat treatment is wetted with a cooling fluid. The resultant additional evaporation of the cooling fluid on the yarn leads, on the one hand, to volatilization of the lubricant constituents in the yarn as well as to cooling of the yarn.

In the following description pertaining to FIG. 13, the structural parts with an identical function are denoted by identical reference characters. In FIG. 13, the protective body has a tubular inner chamber 131 formed by a jacket 132. The jacket 132 lies with one end immediately adjacent to the outlet 144 of the heater 18. Thus, the yarn 4 may run directly into the inner chamber 131 and, at the opposite end, onto a cooling tube 137 for cooling. The jacket 132 has in its middle region an opening 133. The suction line 115 is fastened, concentrically with the opening 133, to the jacket 132. The suction line 115 leads to an extraction device of the type shown, for example, in FIG. 1 so that the inner chamber 131 is connected by the opening 133 and the suction line 115 to the extraction device 14.

The cooling tube 137 projects into the inner chamber 131 through the open end of the protective body directed towards the cooling device. The yarn is wound around the periphery of the cooling tube 137. A bulkhead wall 147 is disposed between the cooling tube and the jacket 132, and encloses the cooling tube 137. Thus, the inner chamber 131 is sealed off from the environment by the bulkhead wall. A yarn opening 148 is introduced in the bulkhead wall 147 at a point on the periphery of the cooling tube to allow unimpeded passage of the yarn out of the inner chamber 131. The yarn opening 148 in the present case is disposed substantially at the opposite side to a condensate outlet opening 130 introduced in the jacket. The condensate outlet opening 130 connects the inner chamber 131 to a collecting line 157. The collecting line 157 is connected to a condensate collecting container (not shown here). The condensate outlet opening in the present case is disposed in the lowest-lying region of the jacket 132 inside the machine.

At the opposite end of the protective body, the jacket 132 is applied substantially sealingly against the heater outlet 144. In the region of the heater outlet 144, a plurality of openings 156 are situated in the jacket 132. Ambient air may pass through the openings 156 into the inner chamber 131.

In the front region of the protective body (viewed in yarn running direction), two nozzles 149 are arranged spaced-apart from one another on the jacket 132. The nozzles project into the inner chamber 131 in such a way that the yarn 4 is conveyed over a running surface 151 formed on the nozzle. A nozzle channel 152 opens funnel-like into the running surface 151. The nozzle channel 152 is connected by a line to a metering device in the form of a metering pump 150 disposed outside of the protective body. The metering pump 150 draws in cooling fluid from a container 155. The cooling fluid, e.g. water, is delivered by the metering pump 150 via the nozzle 149 onto the yarn and/or into the inner chamber 131. Each metering pump 150 is controllable by means of a pump controller 153 and each pump controller 153 is connected to a control unit 154.

In the arrangement shown in FIG. 13, the quantity of cooling fluid may be individually preselected by the respective pump controller. Process-dependent metering of the cooling fluid may be effected by the central control unit 154. It is important, when metering the cooling fluid, that the quantity introduced into the collecting chamber and/or onto the yarn 4 be totally evaporated. The creation of surplus cooling fluid in the inner chamber 131 is thereby avoided. The vapor is fully removed through the suction line 115. With this arrangement, it is assured that the surfaces of the downstream cooling device which are contacted by the yarn remain dry and hence lead to an improved cooling action upon the yarn. The introduction of cooling fluid may—as shown in FIG. 13—be effected by a plurality of nozzles or alternatively by only one nozzle. Such nozzles may also advantageously take the form of atomizing nozzles. This has the advantage that no direct yarn contact between the nozzle and the yarn is required. The atomized cooling fluid is then dispersed like a spray in the inner chamber 131.

For piecing of the yarn, e.g. through the covering of the protective body, the supply of cooling fluid is interrupted by means of the control device 154. The control device 154 may in the present case advantageously be used to activate the hinged mechanism of the protective body. In addition, the nozzles might be moved out of the yarn course for piecing of the yarn.

Given the use of a plurality of nozzles, the nozzles may be arranged in such a way that the yarn is conveyed in an S-shaped or serpentine manner and the nozzles may, for example, be moved away laterally and re-engage purposefully against stops.

With the texturing machine according to the invention it is therefore assured that the vapor arising inside the cooling device is almost totally extracted and removed as condensate. During such process, however, a small amount of ambient air is simultaneously extracted, resulting in low line cross sections and a low energy consumption of the extraction device as well as low loading of the air conditioning installation through extraction. Thus, no major problems with escaping oil vapors arise so that environment-friendly yarn processing is possible with the texturing machine according to the invention.

That which is claimed:

1. A yarn false twist texturing apparatus comprising means for advancing a yarn through a false twist texturing zone which comprises a heater, a cooling device, and a false twisting unit which are serially arranged with respect to each other, said cooling rail having an elongate hollow body which includes a cooling rail having an inside wall surface, and a cover mounted for movement between a closed position overlying the inside wall surface and an open position removed from the cooling rail so as to permit the thread-up of a yarn through the hollow body of the cooling device, and means for withdrawing vapors which emanate from the yarn as the yarn advances through the false twist texturing zone and comprising an opening in said cover, and an extraction device for withdrawing air from within the hollow body and outwardly through the opening.

2. The apparatus as defined in claim 1 wherein the inside wall surface of the cooling rail is generally V-shaped in cross-section.

3. The apparatus as defined in claim 1 wherein the cover comprises a generally flat plate.

4. The apparatus as defined in claim 1 wherein the cover comprises a flexible tube, and wherein the opening in the cover communicates with the interior of the flexible tube and with the interior of the hollow body when the cover is in said closed position.

5. The apparatus as defined in claim 1 wherein the hollow body is inclined to define a lower and, and further comprising a condensate collecting device disposed below the lower end for collecting the condensate forming in the interior of the hollow body.

6. The apparatus as defined in claim 1 wherein the heater comprises a tubular member, and wherein the vapor withdrawing means comprises at least one extraction tube connected to the interior of the hollow body of the cooling device and at least one extraction tube connected to the interior of the tubular member of the heater.

7. The apparatus as defined in claim 1 wherein the vapor withdrawing means comprises a tubular protective body disposed between the heater and the cooling device so as to enclose the advancing yarn therebetween, and at least one extraction tube connected to the interior of the tubular protective body.

8. The apparatus as defined in claim 7 wherein the tubular protective body comprises a tubular jacket defining a yarn passage, and wherein the vapor extraction means includes an opening in said jacket which communicates with said one extraction tube.

9. The apparatus as defined in claim 8 wherein the tubular jacket is inclined to define a lower end, and further comprising a condensate collecting device disposed below the lower end for collecting the condensate forming in the interior of the tubular jacket.

10. The apparatus as defined in claim 8 wherein the tubular jacket defines an upstream end immediately adjacent the heater, and wherein the tubular jacket includes at least one opening adjacent said upstream end for permitting the introduction of outside air into the interior of the jacket.

11. The apparatus as defined in claim 8 wherein the tubular jacket defines an upstream end adjacent the heater so as to define a gap therebetween, with said gap permitting the introduction of outside air into the interior of the jacket.

12. The apparatus as defined in claim 11 further comprising means for mounting the tubular jacket so as to permit longitudinal adjustment with respect to the heater to thereby permit adjustment of the size of the gap and thus the amount of outside air introduced into the interior of the jacket.

13. A yarn false twist texturing apparatus comprising means for advancing a yarn through a false twist texturing zone which comprises a heater, a cooling device, and a false twisting unit which are serially arranged with respect to each other, and said cooling device comprising an elongate hollow body positioned such that the advancing yarn contacts an inside wall surface of the hollow body, said heater comprising a tubular member, means for withdrawing vapors which emanate from the yarn as the yarn advances through the false twist texturing zone and which comprises at least one extraction tube connected to the interior of the hollow body of the cooling device and at least one extraction tube connected to the interior of the tubular member of the heater.

14. A yarn false twist texturing apparatus comprising means for advancing a yarn through a false twist texturing zone which comprises a heater, a cooling device, and a false twisting unit which are serially arranged with respect to each other, wherein the cooling device comprises an elongate body positioned such that the advancing yarn contacts a wall surface of the body, and means for withdrawing vapors which emanate from the yarn as the yarn advances through the false twist texturing zone and comprising a tubular protective body disposed between the heater and the cooling device so as to enclose the advancing yarn therebetween, and at least one extraction tube connected to the interior of the tubular protective body.

15. The apparatus as defined in claim 14 further comprising a nozzle located in the tubular protective body for wetting the yarn with a cooling fluid.

16. The apparatus as defined in claim 14 wherein the tubular protective body comprises a tubular jacket defining a yarn passage, and wherein the tubular jacket is inclined to define a lower end, and further comprising a condensate collecting device disposed below the lower end for collecting the condensate forming in the interior of the tubular jacket.

17. The apparatus as defined in claim 14 wherein the tubular protective body comprises a tubular jacket defining a yarn passage, wherein the tubular jacket defines an upstream end adjacent the heater, and wherein the tubular jacket includes at least one opening adjacent said upstream end for permitting the introduction of outside air into the interior of the jacket.

18. The apparatus as defined in claim 17 wherein the opening into the interior of the jacket is defined by a gap between the upstream end of the jacket and the heater, with the gap permitting the introduction of outside air into the interior of the jacket.

19. The apparatus as defined in claim 18 further comprising means mounting the tubular jacket so as to permit longitudinal adjustment with respect to the heater to thereby permit adjustment of the size of the gap and thus the amount of outside air introduced into the interior of the jacket.

20. A yarn false twist texturing apparatus comprising means for advancing a yarn through a false twist texturing zone which comprises a heater, a cooling device, and a false twisting unit which are serially arranged with respect to each other, means for withdrawing vapors which emanate from the yarn as the yarn advances through the false twist texturing zone, and wherein the cooling device comprises a cooling tube positioned so as to have the advancing yarn run in a helical path over its exterior surface, and wherein the vapor withdrawing means comprises a tubular protective body disposed between the heater and the cooling device so as to enclose the advancing yarn therebetween, and at least one extraction tube connected to the interior of the tubular protective body.

21. The apparatus as defined in 20 claim wherein the cooling tube includes an end positioned to extend into the interior of the tubular protective body.

22. The apparatus as defined in claim 21 wherein a bulkhead wall is positioned between the cooling tube and the interior of the tubular protective body, with said bulkhead wall including an opening to permit the passage of the advancing yarn.

23. A yarn false twist texturing apparatus comprising means for advancing a yarn through a false twist texturing zone which comprises a heater, a cooling device, and a false twisting unit which are serially arranged with respect to each other, and means for withdrawing vapors which emanate from the yarn as the yarn advances through the false twist texturing zone, said vapor withdrawing means comprising a tubular protective body disposed between the heater and the cooling device so as to enclose the advancing yarn therebetween, said tubular protective body comprising a bottom part having an arcuate upper surface when viewed in transverse section, and a top part having an arcuate outer surface when viewed in cross section, with the bottom and top parts being interconnected with the outer surface of the top part resting in the upper surface of the bottom part and so as to permit relative movement between a closed position wherein the body is closed and an open position which permits the thread-up of a yarn into the body.

24. A yarn false twist texturing apparatus comprising means for advancing a yarn through a false twist texturing zone which comprises a heater, a cooling device, and a false twisting unit which are serially arranged with respect to each other, and means for withdrawing vapors which emanate from the yarn as the yarn advances through the false twist texturing zone, said vapor withdrawing means including at least one nozzle for wetting the yarn advancing therethrough with a cooling fluid.

25. A method of false twist texturing an advancing yarn comprising the steps of serially guiding the advancing yarn through a heater, a cooling device, and a false twisting unit, while wetting the advancing yarn with a metered quantity of cooling fluid at a location between the heater and the cooling device, and withdrawing at least a substantial portion of the vapors which emanate from the yarn during its advance through the heater and the cooling device.

26. The method as defined in claim 25 comprising the further step of causing the metered quantity of cooling fluid to substantially totally evaporate.

* * * * *

UNITED STATES PATENT AND TRADEMARK OFFICE
CERTIFICATE OF CORRECTION

PATENT NO. : 6,026,636

DATED : February 22, 2000

INVENTOR(S) : Lorenz et al.

It is certified that error appears in the above-identified patent and that said Letters Patent is hereby corrected as shown below:

Column 14, line 14, "rail having" should read --device comprising--; line 37, "and", first occurrence, should read --end--.

Column 16, line 14, "20 claim" should read --claim 20--.

Signed and Sealed this

Twenty-sixth Day of December, 2000

*Attest:*

Q. TODD DICKINSON

*Attesting Officer*

*Director of Patents and Trademarks*